US007909744B2

(12) United States Patent
Eck

(10) Patent No.: US 7,909,744 B2
(45) Date of Patent: Mar. 22, 2011

(54) GYMNASTICS DEVICE

(75) Inventor: Micheal Eck, Kowloon (HK)

(73) Assignee: Californian Products (H.K.) Ltd., Kowloon (HK)

( * ) Notice: Subject to any disclaimer, the term of this patent is extended or adjusted under 35 U.S.C. 154(b) by 0 days.

(21) Appl. No.: 12/379,882

(22) Filed: Mar. 3, 2009

(65) Prior Publication Data

US 2009/0233772 A1 Sep. 17, 2009

(30) Foreign Application Priority Data

Mar. 6, 2008 (DE) ..... 20 2008 003 266 U

(51) Int. Cl.
*A63B 21/075* (2006.01)

(52) U.S. Cl. ..... 482/106; 482/110

(58) Field of Classification Search ..... 482/12, 482/33–34, 38, 72, 91, 105–109, 121–122, 482/124–129, 148, 908, 44, 50, 92–94, 110, 482/131; D21/679; 84/477 B
See application file for complete search history.

(56) References Cited

U.S. PATENT DOCUMENTS

| | | | | |
|---|---|---|---|---|
| 1,145,127 | A * | 7/1915 | Dunnebacke | 473/47 |
| 4,518,162 | A * | 5/1985 | Oates | 482/93 |
| 4,623,146 | A * | 11/1986 | Jackson | 482/126 |
| 4,664,373 | A * | 5/1987 | Hait | 482/93 |
| 4,682,774 | A * | 7/1987 | Holy | 463/47.5 |
| 5,536,227 | A * | 7/1996 | Polchek et al. | 482/93 |
| 5,588,942 | A * | 12/1996 | Dillard | 482/139 |
| 5,656,002 | A * | 8/1997 | Dittmeier | 482/91 |
| 6,280,364 | B1 * | 8/2001 | Deac et al. | 482/106 |
| 6,293,893 | B1 * | 9/2001 | Truchelut | 482/121 |
| 6,872,174 | B2 * | 3/2005 | Benach | 482/121 |
| D517,135 | S * | 3/2006 | Klein | D21/679 |
| 7,086,999 | B2 * | 8/2006 | Jeneve et al. | 482/106 |
| 7,314,438 | B1 * | 1/2008 | Clark et al. | 482/126 |
| 7,465,259 | B2 * | 12/2008 | Mok | 482/126 |
| 7,591,772 | B2 * | 9/2009 | Shillington | 482/107 |
| 7,722,510 | B2 * | 5/2010 | Jhu | 482/106 |
| 2002/0058448 | A1 * | 5/2002 | Hibler | 440/102 |
| 2004/0023570 | A1 * | 2/2004 | Bridge et al. | 440/101 |
| 2004/0242387 | A1 * | 12/2004 | Benach | 482/126 |
| 2007/0135275 | A1 * | 6/2007 | Oates | 482/109 |
| 2008/0096737 | A1 * | 4/2008 | Ayoub | 482/107 |
| 2008/0280738 | A1 * | 11/2008 | Brennan et al. | 482/129 |
| 2009/0149304 | A1 * | 6/2009 | Smith | 482/126 |
| 2009/0181788 | A1 * | 7/2009 | O'Connor et al. | 473/286 |
| 2009/0215592 | A1 * | 8/2009 | Jhu | 482/110 |
| 2009/0280965 | A1 * | 11/2009 | Shapiro et al. | 482/72 |

FOREIGN PATENT DOCUMENTS

DE 20 2005 020 652 U1 6/2006

* cited by examiner

*Primary Examiner* — Loan Thanh
*Assistant Examiner* — Daniel F Roland
(74) *Attorney, Agent, or Firm* — Welsh Flaxmant + Gitler LLC

(57) ABSTRACT

An exercise device made up of a flexible bar with weights provided on both ends of the bar and with a grip element on the bar between the two bar ends.

9 Claims, 2 Drawing Sheets

FIG. 1
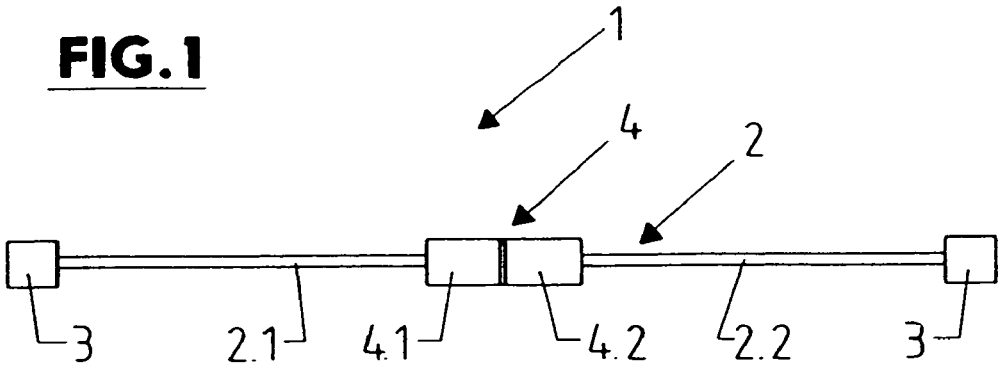
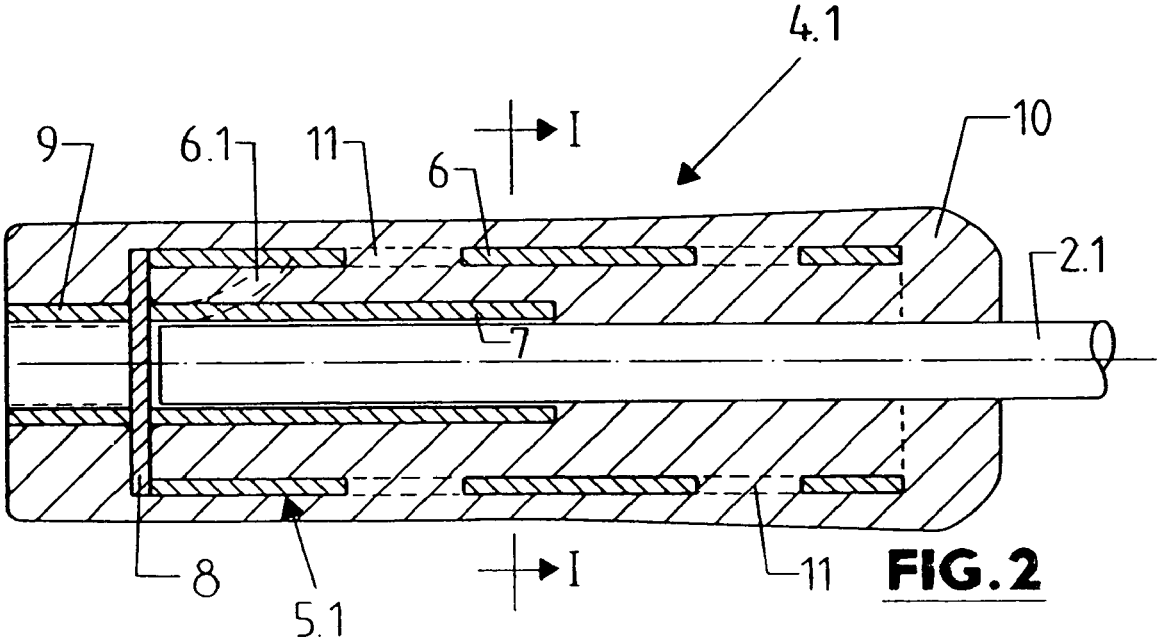
FIG. 2
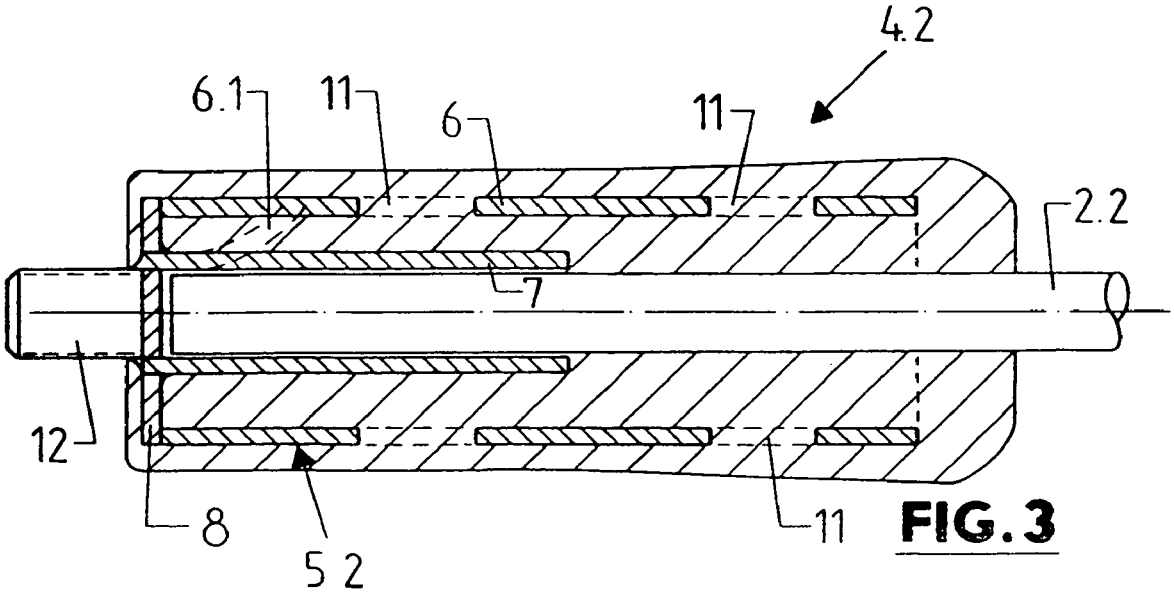
FIG. 3

GYMNASTICS DEVICE

BACKGROUND OF THE INVENTION

The invention relates to an exercise device with a flexible bar with weights provided on both ends of the bar and with a grip element on the bar between the two bar ends.

Exercise devices or exercise bars of this type are known in various embodiments (for example DE 20 2005 020 652 U1) and offer various possibilities for gymnastic or sports exercises, for example by holding the device on a hand grip provided in the middle and by setting the bar or the bar ends provided with the weights in oscillating motions.

The disadvantage of such known exercise devices is their relatively long length, which makes transport and/or storage more difficult. It is an object of the invention is to present an exercise device that avoids this disadvantage.

SUMMARY OF THE INVENTION

The exercise device according to the invention is designed as two parts with two detachably mutually connected device elements. This makes it possible to separate the exercise device into its two parts for transport and/or storage.

During use of the exercise device, the oscillating forces of the weights and the plastic deformation of the bar results in considerable forces between the bar and the hand grip. Especially in the case of a two-part design, which requires separation of the bar into two bar elements or bar parts, this causes very high, constantly changing, i.e. dynamic, loads and bending moments between the respective grip element and the bar element provided on the latter. The embodiment according to the invention effectively prevents the separation of the respective bar element from the corresponding grip element or breaking of the exercise device on the grip element and any resulting injuries.

Further embodiments, advantages and possible applications of the invention are disclosed in the following description of exemplary embodiments and in the drawings. All characteristics described and/or depicted alone or in any combination are fundamentally the subject of the invention, regardless of any summarization in the claims or any direct reference. The content of the claims is also incorporated into the description.

BRIEF DESCRIPTION OF THE DRAWINGS

The invention is explained in more detail below based on an exemplary embodiment with reference to the drawings, in which:

FIG. 1 is a schematic representation in side view of an exercise device according to the invention;

FIGS. 2 and 3 are respectively simplified representations of a longitudinal cross section through a grip element of the hand grip of the exercise device in FIG. 1.

DETAILED DESCRIPTION OF THE INVENTION

Figure 4:
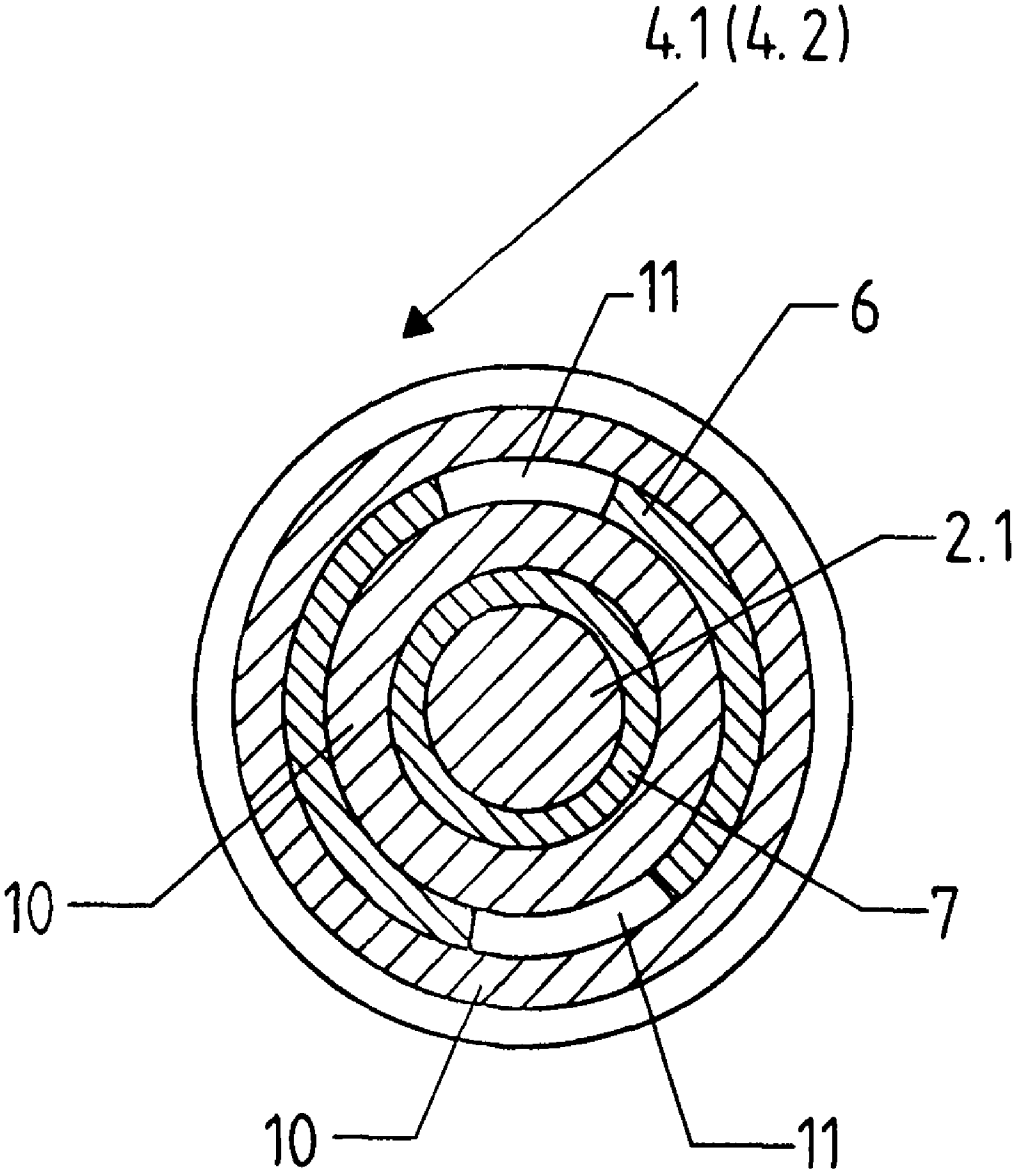
FIG. 4 is a cross section corresponding to line I-I of FIG. 2.

The exercise device generally designated 1 in the drawings is made up of a bar 2 made of a flexible material, for example fiberglass, the ends of which are provided respectively with one mass weight 3, made for example as a preformed part from plastic. The bar 2 is provided in the middle with a hand grip 4.

A special feature of the exercise device or bar 1 is that, to reduce the transport and/or storage length, it can be separated in the area of the hand grip 4, i.e. it consists of two detachably mutually connected parts, each of which comprises a bar element 2.1 or 2.2 with a weight 3 on one end and with half of a hand grip or grip element 4.1 or 4.2 on the other end of the bar element.

The exercise device 1 is used, for example, so that the hand grip 4 is gripped with one hand and then, by moving the hand grip 4 radially to the bar 2, said bar with its weights 3 is set into oscillation.

FIGS. 2 and 3 respectively show in simplified representations a longitudinal cross section through the mutually connectable and detachable hand grip elements 4.1 and 4.2. As the drawings show, each hand grip element is provided inside with a holding and connecting structure 5.1 or 5.2, which is made of a heavy-duty material, for example steel. The structure 5.1 in the depicted embodiment is formed by an outer cylindrical sleeve 6 and an inner sleeve 7 positioned concentrically to the outer sleeve 6. Both sleeves 6 and 7 are mutually connected on one end by a wall section 8, namely so that the inner sleeve 7 extends into an opening in the wall section 8, which is connected both with the sleeve 6 and with the sleeve 7 in a suitable manner, for example by welding or brazing.

In principle, it is also possible to manufacture the outer sleeve 6 using a suitable process, for example by deep drawing or upsetting with the wall section 8, or instead of the wall section 8 to form the outer sleeve 6 so that it encloses with its reduced cross section 6.1 the inner sleeve 7 and is connected by this section with the inner sleeve 7 in a suitable manner, for example by welding or brazing, as indicated in FIG. 2 by the broken line 6.1, so that the wall section 8 can be eliminated. The bar element 2.1 is held with one end so that it fits in the inner sleeve 7 and is fastened there in a suitable manner, for example by a press fit or another means, so that the bar element 2.1 extends with a partial length within the sleeve 7 and protrudes with the by far longer partial length from the open side of the sleeve 7 facing away from the wall section 8 or the section 6.1. On the side facing away from the open sides of the sleeves 6 and 7, a threaded nut element 9 with internal threads is provided on the support and connecting element or structure 5.1, on the same axis as the common axis of the sleeves 6 and 7. The support structure 5.1 and the threaded nut element 9, which likewise is connected for example by welding or brazing with the inner sleeve 7 or the wall section 8, are extrusion coated with an elastomer 10, for example with a thermoplastic elastomer, forming the outer surface of the essentially cylindrical grip element 4.1, namely so that the side of the threaded nut element 9 facing away from the sleeves 6 and 7 and the threaded opening there are exposed. The elastomer forms the outer surface of the essentially cylindrical grip element and completely encloses the support element or support structure 5.1 and the threaded nut element 9 with the exception of the front face of the threaded nut element 9 facing away from the sleeves 6 and 7, so that the elastomer 10 forms a layer ensuring a soft grip surface also in the area of the outer sleeve 6. Further, the space between the sleeves 6 and 7 is completely filled with the elastomer 10. To facilitate the extrusion coating of the support element 5.1 that is pre-mounted with the bar element 2.1 and in particular also to improve the embedding of the support element 5.1 in the elastomer 10, openings 11 are provided in the outer sleeve 6 that are also filled with the elastomer 10 after extrusion coating.

The grip element 4.2 comprises the support element 5.2, which in turn comprises the sleeves 6 and 7 that are mutually connected on one end, the inner sleeve 7 serving to hold and fasten the end of the bar element 2.2 at a distance from the weight 3.

The grip element 4.2 and its support element 5.2 differ from the grip element 4.1 and support element 5.1 only in that instead of the threaded nut element 9 on the side of the support element 5.2 facing away from the open side of the sleeves 6 and 7, a threaded bolt 12 is provided, which can be screwed into the threads of the threaded nut element 9. The supporting element 5.2 is extrusion coated with the elastomer 10 to form the again essentially cylindrical grip element 4.2 so that the support element 2 again is completely embedded in the elastomer, the space between the sleeves 6 and 7, especially also due to the openings 11, is completely filled with the elastomer 10 and only the threaded bolt 12 is exposed, so that the latter can be screwed into the threads of the threaded nut element 9 for connecting the two parts of the exercise device 1.

The described embodiment of the grip elements 4.1 and 4.2 ensures reliable anchoring of the two bar elements 2.1 and 2.2 on said grip elements. It is also especially ensured that even in case of extreme actuation of the exercise device 1, breakage of said device and of the bar elements 2.1 and 2.2 in the proximity of the hand grip 4 is prevented, namely despite the two-part design of the device or of the bar 2.

Since the space between the respective sleeves 6 and 7 is completely filled with the elastomer 10, this results in a large-area connection between these two sleeves, so that forces are reliably transferred from the outer surface of the hand grip 4 to the bar 2 or to the two bar elements 2.1 and 2.2. The sleeves 6 serve for example to reinforce the grip surface of the hand grip 4 or of the grip elements 4.1 and 4.2.

In the case of both grip elements 4.1 and 4.2, the respective inner sleeve 7 has a shorter axial length than the outer sleeve 6, so that a space is formed between the free end of the inner sleeve 7 (i.e. the end at a distance from the wall section 8), in which (sleeve) the respective end of the bar element 2.1 or 2.2 is held, and the end of the outer sleeve 6, said space being completely filled by the elastomer material surrounding the respective bar element, resulting in both high mechanical strength of the connection between the bar element 2.1 or 2.2 and the grip element 4.1 or 4.2 and optimal oscillating properties for the said exercise bar 1.

The invention was described above based on an exemplary embodiment. It goes without saying that numerous modifications and variations are possible without abandoning the underlying inventive idea upon which the invention is based.

REFERENCE LIST

1 exercise bar or exercise device
2 bar made of flexible material, for example fiberglass
2.1, 2.2 bar element
3 weight
4 hand grip
4.1, 4.2 grip element
5.1, 5.2 support element
6, 7 sleeve
6, 1 sleeve section
8 wall section
9 threaded nut element
10 elastomer
11 opening
12 threaded bolt

The invention claimed is:

1. An exercise device comprising a flexible bar with weights provided on both ends of the bar and with a grip element on the bar between the two bar ends, wherein the exercise device has a two-part design comprising two detachably mutually connected parts, each of which is formed by a bar element with a weight on one end and with a grip element on the other end, coupling elements are provided on the grip elements for detachably connecting the grip elements, and a support or anchoring element made of a heavy-duty material is provided in each grip element, and on the support element, there is provided the coupling element corresponding to a respective grip element and a sleeve-like holder for the end of the bar element that is distant from a respective weight, and wherein the support or anchoring element comprises a wall element, embodied as a sleeve, enclosing the sleeve-like holder at a distance.

2. The exercise device according to claim 1, wherein the support or anchoring element is made of metal, steel or a fiber reinforced plastic.

3. The exercise device according to claim 2, wherein the support or anchoring element is enclosed respectively by a plastic material, forming the grip element or its outer surface.

4. The exercise device according to claim 1, wherein the coupling elements are accessible on one front face of the grip elements.

5. The exercise device according to claim 1, wherein the wall element is connected with the sleeve-like holder by a wall section or a section of the wall element with a tapered cross section.

6. The exercise device according to claim 3, wherein the plastic material also fills a space between the sleeve-like holder and the wall element.

7. The exercise device according to claim 1, wherein the respective coupling element is provided on the support or anchoring element at a position where the sleeve-like holder and the wall element enclosing said holder are mutually connected.

8. The exercise device according to claim 1, wherein openings are provided in the wall element enclosing the sleeve-like holder.

9. The exercise device according to claim 1, wherein the sleeve-like holder has a shorter axial length than the wall element enclosing said holder.

* * * * *